US009225078B1

(12) United States Patent
Nelson et al.

(10) Patent No.: US 9,225,078 B1
(45) Date of Patent: Dec. 29, 2015

(54) ELECTRICAL CONNECTORS

(71) Applicant: Homer TLC, Inc., Wilmington, DE (US)

(72) Inventors: Michael R. Nelson, Peachtree City, GA (US); Brian VanHiel, Smyrna, GA (US); Kirk Charles, Austell, GA (US); Adam Ambrecht, Kennesaw, GA (US)

(73) Assignee: Homer TLC, Inc., Wilmington, DE (US)

( * ) Notice: Subject to any disclaimer, the term of this patent is extended or adjusted under 35 U.S.C. 154(b) by 0 days.

(21) Appl. No.: 14/712,798

(22) Filed: May 14, 2015

Related U.S. Application Data

(63) Continuation of application No. 14/609,302, filed on Jan. 29, 2015.

(51) Int. Cl.
*H01R 4/26* (2006.01)
*H01R 13/58* (2006.01)
*H01R 4/24* (2006.01)

(52) U.S. Cl.
CPC ..... *H01R 4/2416* (2013.01)

(58) Field of Classification Search
CPC ..... H01R 4/2416
USPC ..... 439/387, 389, 391, 409, 430, 444, 460, 439/465–468
See application file for complete search history.

(56) References Cited

U.S. PATENT DOCUMENTS 2,408,045 A 9/1946 Cottrell
2,587,239 A 2/1952 Smith
2,700,142 A 1/1955 Benander
3,115,541 A 12/1963 Hanner et al.
3,184,704 A 5/1965 Raymond et al.
3,816,818 A 6/1974 Meier
3,821,691 A 6/1974 Reimer
3,835,444 A 9/1974 Plana et al.
(Continued)

FOREIGN PATENT DOCUMENTS

EP 0726623 8/1996
EP 1094569 4/2001
(Continued)

OTHER PUBLICATIONS

Photographs of KTE Electrical Ltd. cable connector that existed prior to Jan. 29, 2015.

*Primary Examiner* — Sherman Ng
(74) *Attorney, Agent, or Firm* — Norton Rose Fulbright US LLP

(57) ABSTRACT

Electrical connectors including a cable clamp (e.g., having a first clamp portion, a second clamp portion, and a hinge coupled to the first and second clamp portions such that the first and second clamp portions are movable relative to each other between an open position and a closed position in which the first and second clamp portions define a cable passageway), and a piercing conductor configured to place a fixture wire into electrical communication with an electrical cable disposed within the cable passageway. In at least some of these electrical connectors, a longitudinal axis of the cable passageway is substantially aligned with a longitudinal axis of the cable clamp when the first and second clamp portions are in the closed position. In at least some of these electrical connectors, at least one of the clamp portions comprises a flexible sidewall that at least partially defines the cable passageway.

8 Claims, 9 Drawing Sheets

(56) References Cited

U.S. PATENT DOCUMENTS

| | | | |
|---|---|---|---|
| 3,874,762 | A | 4/1975 | Shott et al. |
| 4,027,096 | A | 5/1977 | Waddington et al. |
| 4,097,104 | A | 6/1978 | Furey et al. |
| 4,201,436 | A | 5/1980 | Genovese et al. |
| 4,274,696 | A | 6/1981 | Long et al. |
| 4,283,104 | A | 8/1981 | Pemberton |
| 4,516,822 | A | 5/1985 | Wolfel |
| 4,547,033 | A | 10/1985 | White et al. |
| 4,648,674 | A | 3/1987 | Sanchez |
| 4,749,367 | A | 6/1988 | Fraser |
| 4,778,405 | A | 10/1988 | Sterken |
| 4,793,824 | A | 12/1988 | Cozzens et al. |
| 4,861,278 | A | 8/1989 | McBride et al. |
| 4,902,245 | A | 2/1990 | Olsson |
| 4,915,650 | A | 4/1990 | Daly et al. |
| 4,921,439 | A | 5/1990 | Bofill et al. |
| 4,921,442 | A | 5/1990 | Puerner |
| 4,941,844 | A | 7/1990 | Bowden et al. |
| 4,973,263 | A | 11/1990 | Nielsen |
| 5,007,855 | A | 4/1991 | O'Brien et al. |
| 5,041,012 | A | 8/1991 | Caprio |
| 5,041,013 | A | 8/1991 | Greenbaum |
| 5,080,604 | A | 1/1992 | Rider et al. |
| 5,080,606 | A | 1/1992 | Burkard |
| 5,147,217 | A | 9/1992 | Neale et al. |
| 5,174,783 | A | 12/1992 | Stassen et al. |
| 5,203,716 | A | 4/1993 | Martucci et al. |
| 5,219,303 | A | 6/1993 | Daly et al. |
| 5,330,367 | A | 7/1994 | Janczak |
| 5,338,220 | A | 8/1994 | Soes et al. |
| 5,371,323 | A | 12/1994 | Schneider et al. |
| 5,378,171 | A | 1/1995 | Czerlanis |
| 5,435,747 | A | 7/1995 | Franckx et al. |
| 5,450,664 | A | 9/1995 | Babow et al. |
| 5,482,475 | A | 1/1996 | Kawaguchi |
| RE35,325 | E | 9/1996 | Wass et al. |
| 5,562,478 | A | 10/1996 | Yamamoto |
| 5,839,911 | A | 11/1998 | Dinkel |
| 5,855,492 | A | 1/1999 | Abe et al. |
| 5,959,394 | A | 9/1999 | Lin |
| 6,010,356 | A | 1/2000 | Hale et al. |
| 6,019,627 | A | 2/2000 | Embo et al. |
| 6,037,679 | A | 3/2000 | Pirillo |
| 6,135,808 | A | 10/2000 | Hale et al. |
| 6,196,862 | B1 | 3/2001 | Dooley |
| 6,261,119 | B1 | 7/2001 | Green |
| 6,328,593 | B1 | 12/2001 | Chang et al. |
| 6,354,864 | B1 | 3/2002 | Kusumoto et al. |
| 6,364,690 | B1 | 4/2002 | Nehm-Engelberts |
| 6,383,013 | B1 | 5/2002 | Ghesia et al. |
| 6,450,844 | B1 | 9/2002 | Mizumura et al. |
| 6,558,184 | B1 | 5/2003 | Melocchi et al. |
| 6,565,375 | B1 | 5/2003 | Daoud et al. |
| 6,604,956 | B2 | 8/2003 | Ruiz et al. |
| 6,716,055 | B1 | 4/2004 | Echito |
| 6,848,933 | B1 | 2/2005 | Delaney et al. |
| 6,860,752 | B2 | 3/2005 | McCoy et al. |
| 6,960,716 | B2 | 11/2005 | Matsumi et al. |
| 6,974,347 | B1 | 12/2005 | Lin |
| 7,063,556 | B1 | 6/2006 | Wong et al. |
| 7,066,764 | B2 | 6/2006 | Bolouri-Saransar |
| 7,074,093 | B2 | 7/2006 | Saka et al. |
| 7,134,903 | B1 * | 11/2006 | Pavlovic ..... 439/404 |
| 7,144,269 | B2 | 12/2006 | Libby et al. |
| 7,351,092 | B2 | 4/2008 | Tseng |
| 7,377,813 | B2 | 5/2008 | Pentell et al. |
| D577,672 | S | 9/2008 | Yao |
| 7,442,070 | B2 | 10/2008 | Lee |
| 7,448,900 | B1 | 11/2008 | Chen |
| 7,540,758 | B2 | 6/2009 | Ho |
| 7,604,498 | B2 | 10/2009 | Mahajan |
| D603,804 | S | 11/2009 | Urano |
| 7,637,769 | B2 | 12/2009 | Garcia et al. |
| 7,645,173 | B2 | 1/2010 | Larkin |
| 7,731,521 | B2 | 6/2010 | Corradi et al. |
| 7,740,511 | B2 | 6/2010 | Katano |
| D636,344 | S | 4/2011 | Naito |
| D645,408 | S | 9/2011 | Chartrand et al. |
| 8,022,821 | B2 | 9/2011 | Joseph et al. |
| 8,187,022 | B2 | 5/2012 | Li et al. |
| 8,212,377 | B2 | 7/2012 | Joseph et al. |
| D668,610 | S | 10/2012 | Li et al. |
| 8,450,944 | B2 | 5/2013 | Joseph |
| 8,534,614 | B2 | 9/2013 | Guthke et al. |
| 8,622,765 | B2 | 1/2014 | Sulzer |
| 8,647,147 | B2 | 2/2014 | Chartrand et al. |
| 8,651,435 | B2 | 2/2014 | Guthke et al. |
| 8,727,289 | B2 | 5/2014 | Abbott et al. |
| 8,900,005 | B2 | 12/2014 | Taylor |
| 8,991,773 | B2 | 3/2015 | Guthke et al. |
| 9,033,287 | B2 | 5/2015 | Zyrull et al. |
| 2004/0156198 | A1 | 8/2004 | Chen |
| 2005/0064759 | A1 * | 3/2005 | Libby et al. ..... 439/409 |
| 2007/0249204 | A1 | 10/2007 | Petersen et al. |
| 2010/0002419 | A1 | 1/2010 | Naito |
| 2010/0203752 | A1 | 8/2010 | Urano |
| 2010/0267289 | A1 | 10/2010 | Urano |
| 2011/0006169 | A1 | 1/2011 | Abbott |
| 2011/0223798 | A1 | 9/2011 | Chartrand et al. |
| 2012/0037765 | A1 | 2/2012 | Guthke et al. |
| 2012/0315785 | A1 | 12/2012 | Taylor |
| 2014/0113483 | A1 | 4/2014 | Chartrand et al. |

FOREIGN PATENT DOCUMENTS

| | | |
|---|---|---|
| EP | 2395604 | 12/2011 |
| WO | WO99/60669 | 11/1999 |
| WO | WO99/65115 | 12/1999 |
| WO | WO2005/112198 | 11/2005 |
| WO | WO2010/014951 | 2/2010 |

* cited by examiner

ELECTRICAL CONNECTORS

CROSS-REFERENCE(S) TO RELATED APPLICATION(S)

This is a continuation of co-pending U.S. patent application Ser. No. 14/609,302, filed Jan. 29, 2015, the contents of which are incorporated by reference.

BACKGROUND

1. Field of Invention

The present invention relates generally to electrical connectors, and more specifically, but not by way of limitation, to low voltage electrical connectors (e.g., for use in landscape lighting).

2. Description of Related Art

In some instances, electricity (e.g., low voltage electricity, supplied by a transformer) may be communicated through an electrical cable that is disposed proximate to locations where it may be desirable to place an electrical device (e.g., such as a light fixture, for example, during installation of landscape lighting). Proximate to these locations, an electrical connector, such as a low voltage electrical connector, may be used to power the electrical device by tapping into electricity communicated through the electrical cable.

Low voltage electrical connectors typically work by piercing or cutting insulation around an electrical cable to place a secondary or fixture wire into electrical communication with the electrical cable. Proper electrical cable orientation relative to a low voltage electrical connector may be critical to ensure an effective electrical connection, particularly during piercing or cutting of the electrical cable. However, typical low voltage electrical connectors may be unable to adequately position an electrical cable for piercing or cutting, and/or to retain the electrical cable relative to the low voltage electrical connectors. Additionally, such typical low voltage electrical connectors may be used with, but not necessarily designed for, electrical cables of varying sizes and/or gauges, which may further complicate use of the low voltage electrical connectors. Existing low voltage electrical connectors may also require a user to exert excessive effort in order to effectively pierce or cut an electrical cable.

SUMMARY

Some embodiments of the present electrical connectors are configured, through a cable clamp that defines a cable passageway having a longitudinal axis that is substantially aligned with a longitudinal axis of the cable clamp, to effectively position an electrical cable relative to the electrical connector for piercing or cutting, to retain the electrical cable relative to the electrical connector, and/or the like. Some embodiments of the present electrical connectors are configured, through a flexible sidewall that at least partially defines a cable passageway, to accommodate electrical cables of varying sizes and/or gauges, to retain an electrical cable relative to the electrical connector, and/or the like. Some embodiments of the present electrical connectors are configured, through at least one clamp portion having a first end hingedly coupled to another clamp portion and a second end defining a gripping surface, to assist a user in piercing or cutting an electrical cable disposed between the clamp portions (e.g., by providing leverage).

Some embodiments of the present electrical connectors comprise: a cable clamp comprising a first clamp portion, a second clamp portion, a hinge coupled to the first and second clamp portions such that the first and second clamp portions are movable relative to each other between an open position and a closed position in which the first and second clamp portions define a cable passageway, and a fixture wire passageway, and a piercing conductor coupled to the cable clamp and configured to place a fixture wire disposed within the fixture wire passageway into electrical communication with an electrical cable disposed within the cable passageway when the first and second clamp portions are in the closed position. In some embodiments, the first clamp portion, second clamp portion, and hinge are unitary with one another. In some embodiments, the cable clamp comprises nylon.

In some embodiments of the present electrical connectors, the first and second clamp portions are movable relative to each other in a plane between the open position and the closed position, and the fixture wire passageway has a longitudinal axis that is non-parallel to the plane. In some embodiments, the fixture wire passageway has a longitudinal axis that is non-parallel to a longitudinal axis of the cable passageway. In some embodiments, a longitudinal axis of the cable passageway is substantially aligned with a longitudinal axis of the cable clamp when the first and second clamp portions are in the closed position. In some embodiments, the cable passageway extends through the cable clamp.

In some embodiments of the present electrical connectors, at least one of the first and second clamp portions comprises a flexible sidewall that at least partially defines the cable passageway. In some embodiments, the sidewall is defined, at least in part, by a portion that extends from the at least one of the first and second clamp portions in a first direction that is substantially perpendicular to a longitudinal axis of the cable passageway and increases in a thickness along the first direction. In some embodiments, the sidewall defines a groove. In some embodiments, the sidewall tapers in a transverse dimension along a longitudinal axis of the cable passageway. In some embodiments, the sidewall is configured such that an interior transverse dimension of the cable passageway varies along a longitudinal axis of the cable passageway.

In some embodiments of the present electrical connectors, the piercing conductor is configured to cut insulation around the electrical cable in a direction substantially parallel to a longitudinal axis of the cable passageway. In some embodiments, the piercing conductor defines an opening configured to receive the fixture wire. Some embodiment comprise a fixture wire disposed in the opening. In some embodiments, the piercing conductor comprises a barb configured to locate the piercing conductor relative to the cable clamp.

In some embodiments of the present electrical connectors, the hinge defines a recess configured to receive at least a portion of the electrical cable when the first and second clamp portions are in the closed position. In some embodiments, the cable passageway extends through the hinge.

Some embodiments of the present electrical connectors comprise a latch configured to releasably secure the first and second clamp portions in the closed position. In some embodiments, the cable passageway extends through the latch.

In some embodiments of the present electrical connectors, at least one of the first and second clamp portions comprises a gripping surface configured to facilitate movement of the first and second clamp portions to the closed position. In some embodiments, at least one of the first and second clamp portions comprises a first end coupled to the hinge and a second end defining a gripping surface configured to facilitate movement of the first and second clamp portions to the closed position.

Some embodiments of the present methods comprise: disposing an electrical cable within a recess defined by a first clamp portion of a cable clamp, moving a second clamp portion of the cable clamp relative to the first clamp portion to a closed position in which the cable clamp defines a cable passageway having a longitudinal axis that is substantially aligned with a longitudinal axis of the cable clamp when the first and second clamp portions are in the closed position, and placing a fixture wire into electrical communication with the electrical cable, the fixture wire disposed in a fixture wire passageway of the cable clamp having a longitudinal axis that is non-parallel to the longitudinal axis of the cable passageway.

Some embodiments of the present methods comprise: disposing a fixture wire into a fixture wire passageway of a first clamp portion of a cable clamp and inserting a piercing conductor into the first clamp portion such that the fixture wire is retained relative to the first clamp portion and is in electrical communication with the piercing conductor, where the cable clamp comprises a second clamp portion movable relative to the first clamp portion to a closed position in which the cable clamp defines a cable passageway having a longitudinal axis that is substantially aligned with a longitudinal axis of the cable clamp when the first and second clamp portions are in the closed position. In some embodiments, inserting the piercing conductor cuts insulation of the fixture wire.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1A:
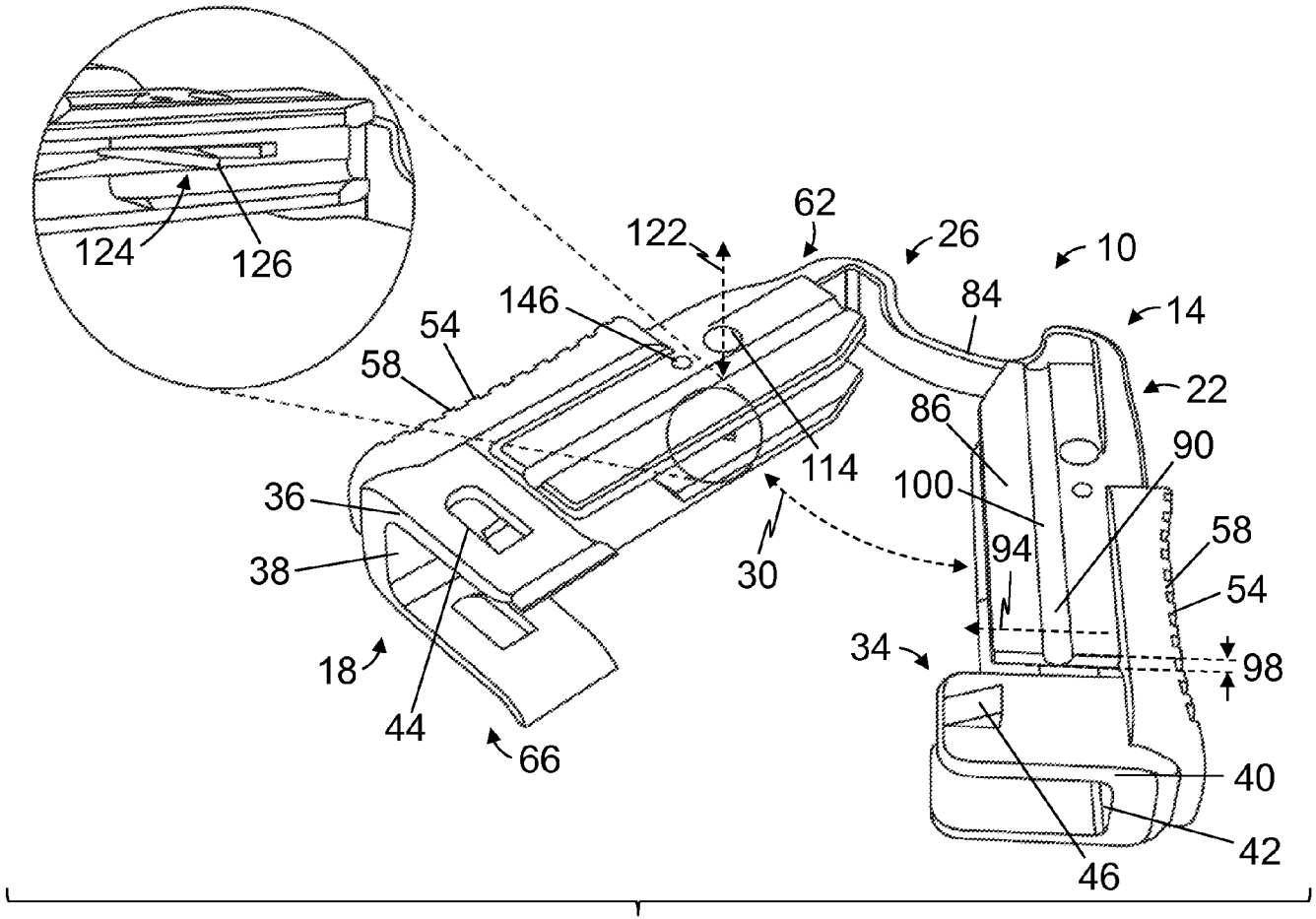
FIG. 1A is a perspective view of one embodiment of the present electrical connectors, shown in an open position.

Referring now to the drawings, and more particularly to FIGS. 1A-3F, shown therein and designated by the reference numeral 10 is one embodiment of the present electrical connectors. In the embodiment shown, electrical connector 10 comprises a cable clamp 14 including and/or defining a first clamp portion 18 and a second clamp portion 22. In this embodiment, cable clamp 14 comprises nylon; however, in other embodiments, respective cable clamps (e.g., 14) may comprise any suitable (e.g., non-conductive) material.

In the depicted embodiment, first clamp portion 18 is movably (e.g., hingedly) coupled to second clamp portion 22. For example, in the embodiment shown, cable clamp 14 comprises and/or defines a hinge 26 coupled to first and second clamp portions, 18 and 22, respectively, such that the first and second clamp portions are movable relative to each other (e.g., generally along a direction indicated by arrow 30) between an open position (FIGS. 1A-2A) and a closed position (FIGS. 2B-3F). In electrical connector 10, first and second clamp portions, 18 and 22, respectively, are movable relative to each other in a plane (e.g., 34, FIGS. 1B and 1C). Plane 34 may be defined as a plane that intersects at least a portion of first clamp portion 18 and at least a portion of second clamp portion 22 as the first clamp portion is moved relative to the second clamp portion between the open position and the closed position. Such relative movement of first and second clamp portions, 18 and 22, respectively, between the open position and the closed position in plane 34 does not require that the relative movement be purely planar, that a portion of the first clamp portion intersected by the plane be the same portion throughout the relative movement, or that a portion of the second clamp portion intersected by the plane be the same portion throughout the relative movement.

In this embodiment, first clamp portion 18, second clamp portion 22, and hinge 26 are each unitary and/or integrally formed with one another (e.g., hinge 26 is a living hinge); however, in other embodiments, respective hinges (e.g., 26) may be unitary and/or integrally formed with one or neither of respective first or second clamp portions (e.g., 18, 22, respectively), and the respective hinges may be coupled to one or both of the respective first or second clamp portions through, for example, fasteners, adhesives, and/or the like. In yet other embodiments, respective hinges (e.g., 26) may be omitted, and respective first clamp portions (e.g., 18) and second clamp portions (e.g., 22) may be slidably coupled to one another, physically separable from one another, and/or the like.

In the depicted embodiment, cable clamp 14 comprises a latch 34 configured to releasably secure first clamp portion 18 and second clamp portion 22 in the closed position. For example, in the embodiment shown, latch 34 comprises a first (e.g., U-shaped) sidewall 36 coupled to and/or defined by first clamp portion 18 and defining a first recess 38. In this embodiment, latch 34 comprises a second (e.g., U-shaped) sidewall 40 coupled to and/or defined by second clamp portion 22 and defining a second recess 42. In the depicted embodiment, as first clamp portion 18 is moved relative to second clamp portion 22 towards the closed position, first sidewall 36 may receive second sidewall 40 (e.g., within first recess 38). In the embodiment shown, first sidewall 36 defines one or more openings 44, which may be in communication with first recess 38, configured to receive one or more locking protrusions 46, which may be coupled to and/or defined by defined by second sidewall 40, to secure first clamp portion 18 and second clamp portion 22 in the closed position. For example, in this embodiment, as first and second clamp portions, 18 and 22, respectively, near the closed position, first sidewall 36 may flex outwardly as second sidewall 40 and/or one or more locking protrusions 46 are received by first recess 38. In the depicted embodiment, as first clamp portion 18 and second clamp portion 22 reach the closed position, each of one or more locking protrusions 46 may be received within a corresponding one of one or more openings 44, thus securing the first and second clamp portions in the closed position (FIG. 2B) (e.g., as well as an electrical cable 74 between the first and second clamp portions, which might otherwise cause separation of the first and second clamp portions). In the embodiment shown, first sidewall 36 may be flexed outwardly and/or second sidewall 40 may be flexed inwardly (e.g., through application of force to the first and/or second sidewall(s) by a user) such that each of one or more locking protrusions 46 may be removed from a corresponding one of one or more openings 44, thereby allowing the first and second clamp portions, 18 and 22, respectively, to be moved from the closed position. The above description of latch 34 is provided only by way of example, as other embodiments of the present electrical connectors can comprise any suitable respective latch (e.g., 34), and in yet other embodiments, such latches may be omitted.

In this embodiment, at least one of first clamp portion 18 and second clamp portion 22 (e.g., in the depicted embodiment, each of the first and second clamp portions) comprises a gripping surface 54 configured to facilitate relative movement of the first and second clamp portions (e.g., to the closed position). For example, in electrical connector 10, gripping surface(s) 54 are defined by exterior portions of clamp 14, such that a user may apply a force to the gripping surface(s) in a direction substantially transverse to an electrical cable 74 disposed between first and second clamp portions, 18 and 22, respectively, to move the first and second clamp portions to the closed position. In the embodiment shown, gripping surface 54 is concave or generally concave, such that, for example, the gripping surface may receive one or more fingers of a user during operation of electrical connector 10 (e.g., as the user grasps cable clamp 14, for example, to pierce or cut an electrical cable 74, as described in more detail below). In this embodiment, gripping surface 54 is configured to enhance a user's grip on electrical connector 10, and more particularly, on cable clamp 14. For example, in the depicted embodiment, gripping surface 54 defines a plurality of ribs 58 (e.g., configured to minimize slippage of a user's hand relative to the gripping surface); however, in other embodiments, respective gripping surface(s) (e.g., 54) can comprise any suitable surface, such as, for example, a surface of a respective clamp portion (e.g., 18, 22, and/or the like) a textured surface, and/or the like.

In the embodiment shown, cable clamp 14, and more particularly, gripping surface 54, is configured to assist a user in piercing or cutting an electrical cable 74 (e.g., with cutting point or edge 126 of piercing conductor 124, described in more detail below) (e.g., by providing for a mechanical advantage over the electrical cable). For example, in this embodiment, at least one of first clamp portion 18 and second clamp portion 22 (e.g., in the depicted embodiment, both of the first and second clamp portions) comprises a first end 62 coupled to hinge 26, and a second end 66 defining a gripping surface 54 (e.g., such that the gripping surface is spaced apart from the hinge, and cutting point or edge 126 is disposed between the hinge and at least a portion of the gripping surface). In at least this way, some embodiments of the present electrical connectors are configured to minimize a force required to effectively pierce or cut an electrical cable.

Figure 3A:
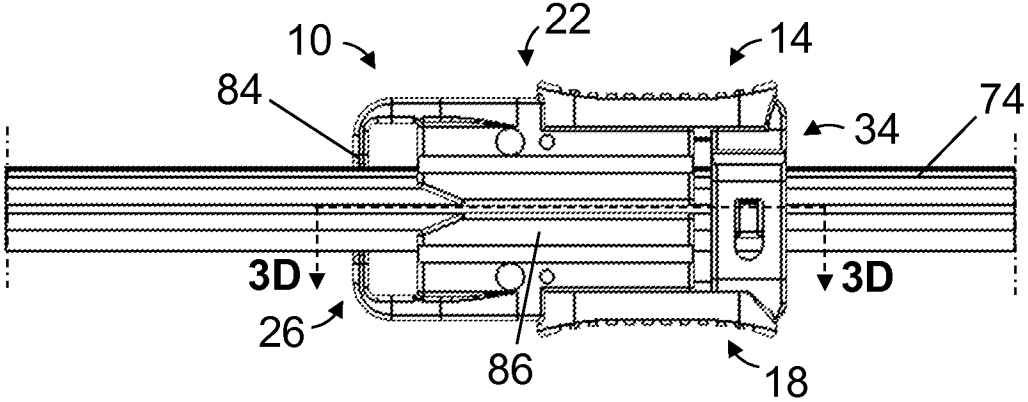
FIGS. 3A and 3B are top and bottom views, respectively, of the embodiment of FIG. 1A, shown in a closed position and with an electrical cable.
Figure 3B:
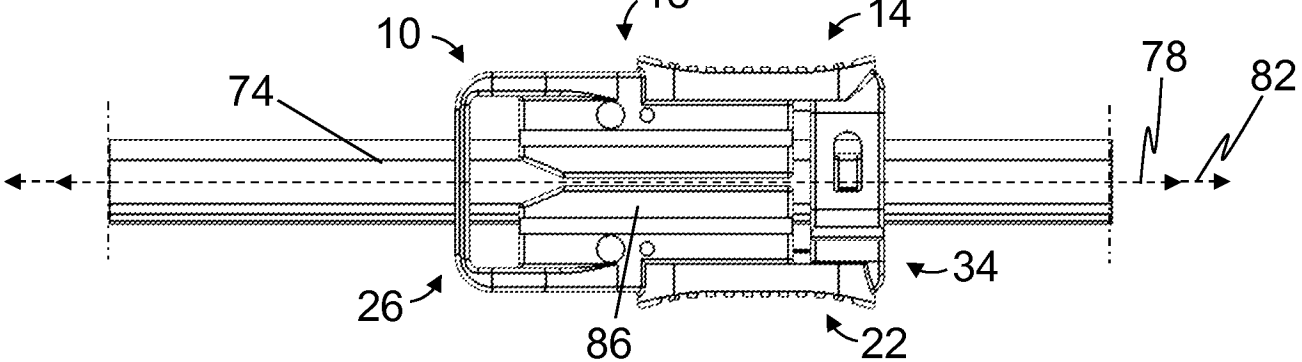
Figure 3C:
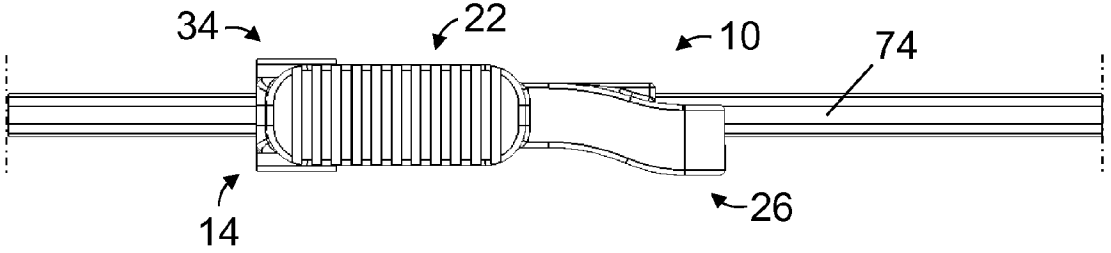
FIG. 3C is a side view of the embodiment of FIG. 1A, shown in a closed position and with an electrical cable.
Figure 3D:
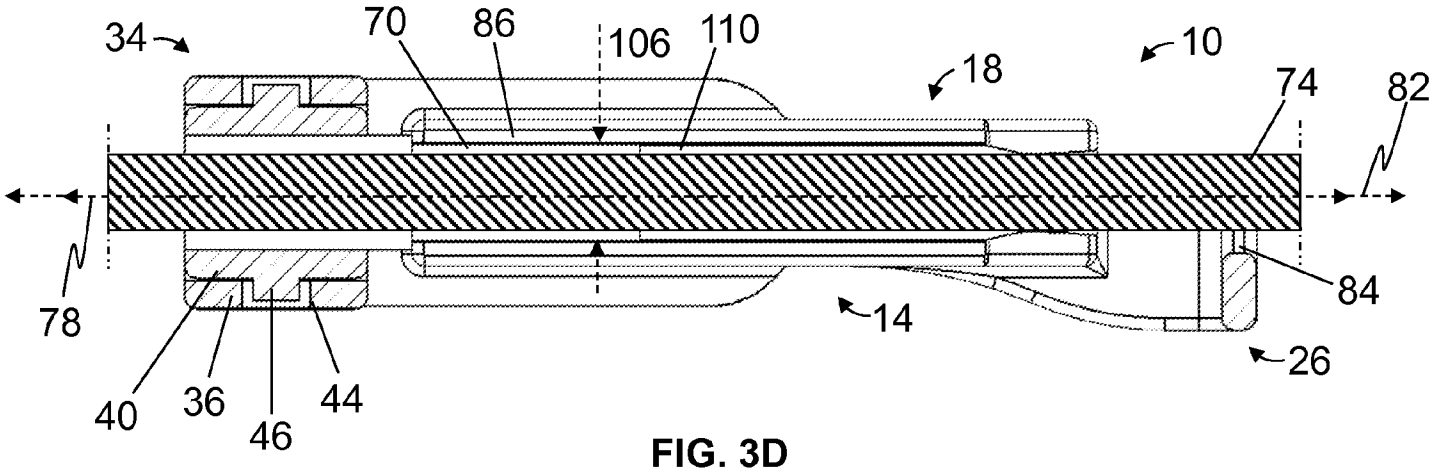
FIG. 3D is a cross-sectional side view of the embodiment of FIG. 1A, shown in a closed position and with an electrical cable, taken along the line 3D-3D of FIG. 3A.
Figure 3E:
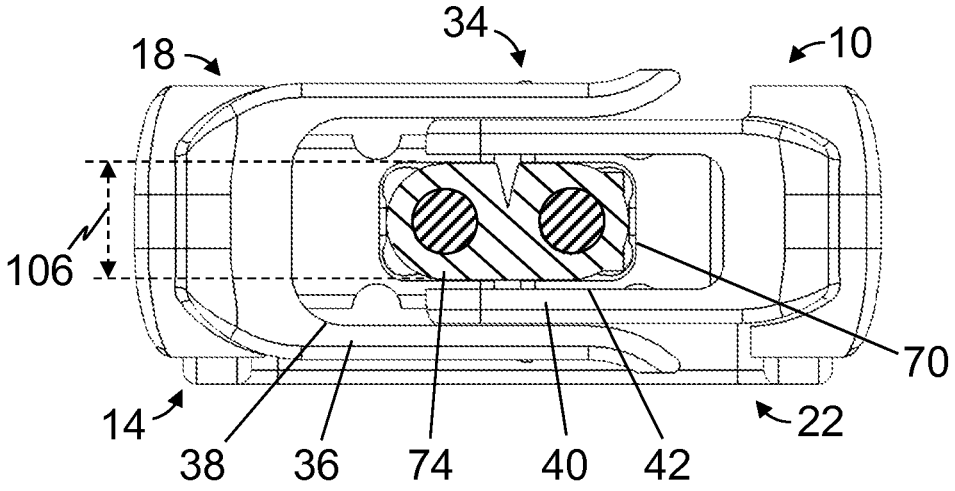
FIGS. 3E and 3F are front and back views, respectively, of the embodiment of FIG. 1A, shown in a closed position and with an electrical cable.
Figure 3F:
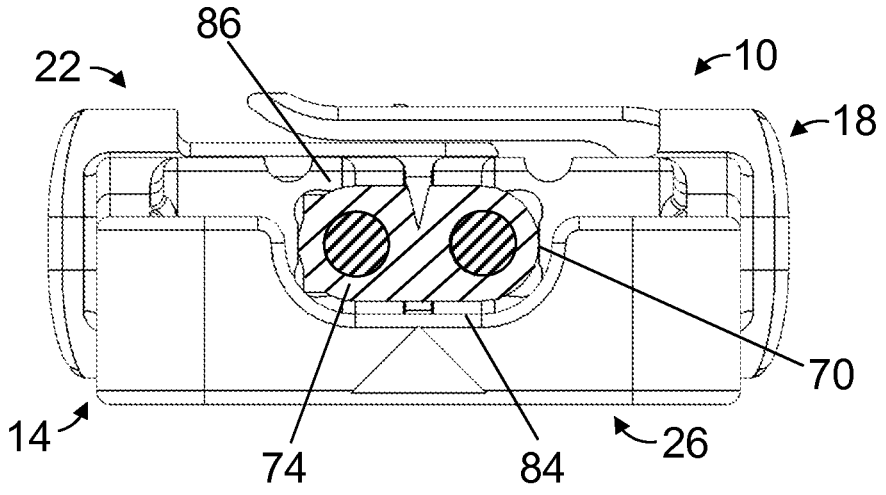

In the embodiment shown, first clamp portion 18 and second clamp portion 22, when in the closed position, define a cable passageway 70 configured to receive an electrical cable 74 (FIG. 3D). The present electrical connectors may be used with any suitable electrical cable (e.g., 74), such as, for example, electrical cables having wires with a size of 14 American wire gauge (AWG) or smaller, and/or wires with a size between any two of or greater than any of one of 14 AWG, 12 AWG, 10 AWG, 8 AWG, 6 AWG, 4 AWG, 2 AWG, 0 AWG, and/or 00 AWG, whether the electrical cables are single- or multicore, and whether the electrical cables are flexible or inflexible. In this embodiment, cable passageway 70 has a longitudinal axis 78 that is substantially aligned with (e.g., parallel or substantially parallel to) a longitudinal axis 82 of cable clamp 14 when first and second clamp portions, 18 and 22, respectively, are in the closed position. In the depicted embodiment, hinge 26 defines a recess or cradle 84 configured to receive at least a portion of electrical cable 74 (e.g., which may serve as and/or comprise an indicator for assisting a user in properly orienting the electrical cable within and/or relative to connector 10). For example, in the embodiment shown, cable passageway 70 extends through hinge 26, such that, for example, the hinge may assist electrical connector 10 in retention of the electrical cable. In this embodiment, cable passageway 70 extends through latch 34 (e.g., through first recess 38 and/or second recess 42), such that, for example, the latch may assist electrical connector 10 in retention of the electrical cable. In these ways and others, some embodiments of the present electrical connectors may be configured to effectively position an electrical cable relative to the electrical connector for piercing or cutting, to retain the electrical cable relative to the electrical connector, and/or the like (e.g., effectively positioned or retained such that the electrical cable is disposed within the electrical connector substantially parallel to the electrical connector, for example, substantially parallel to a cable passageway 70, a longitudinal axis 78, and/or a longitudinal axis 82).

In the depicted embodiment, at least one of first clamp portion 18 and second clamp portion 22 (e.g., in the embodiment shown, both of the first and second clamp portions) comprises a flexible (e.g., or semi-rigid) sidewall 86 that at least partially defines cable passageway 70 (e.g., flexible sidewall(s) 86 may be characterized as elongated, for example, along cable passageway 70 or a longitudinal axis 78 thereof). Respective flexible sidewalls (e.g., 86) of the present electrical connectors may comprise a flexible structure, a flexible material, and/or the like. For example, in this embodiment, flexible sidewall 86 is defined, at least in part, by a portion 90 that extends from a respective one of first clamp portion 18 and second clamp portion 22 in a first direction 94 that is substantially perpendicular to longitudinal axis 78 of cable passageway 70, where portion 90 increases in a thickness 98 along the first direction (FIG. 1A). To illustrate, portion 90 may define a structure of or similar to a living hinge, such that portions of flexible sidewall 86 may flex relative to one another, relative to other portions of electrical connector 10, and/or the like. By way of further example, in the depicted embodiment, flexible sidewall 86 defines a groove 100. In these ways and others, some embodiments of the present electrical connectors may be configured to accommodate electrical cables of varying sizes and/or gauges, to retain an electrical cable relative to the electrical connector, and/or the like.

Figure 1B:
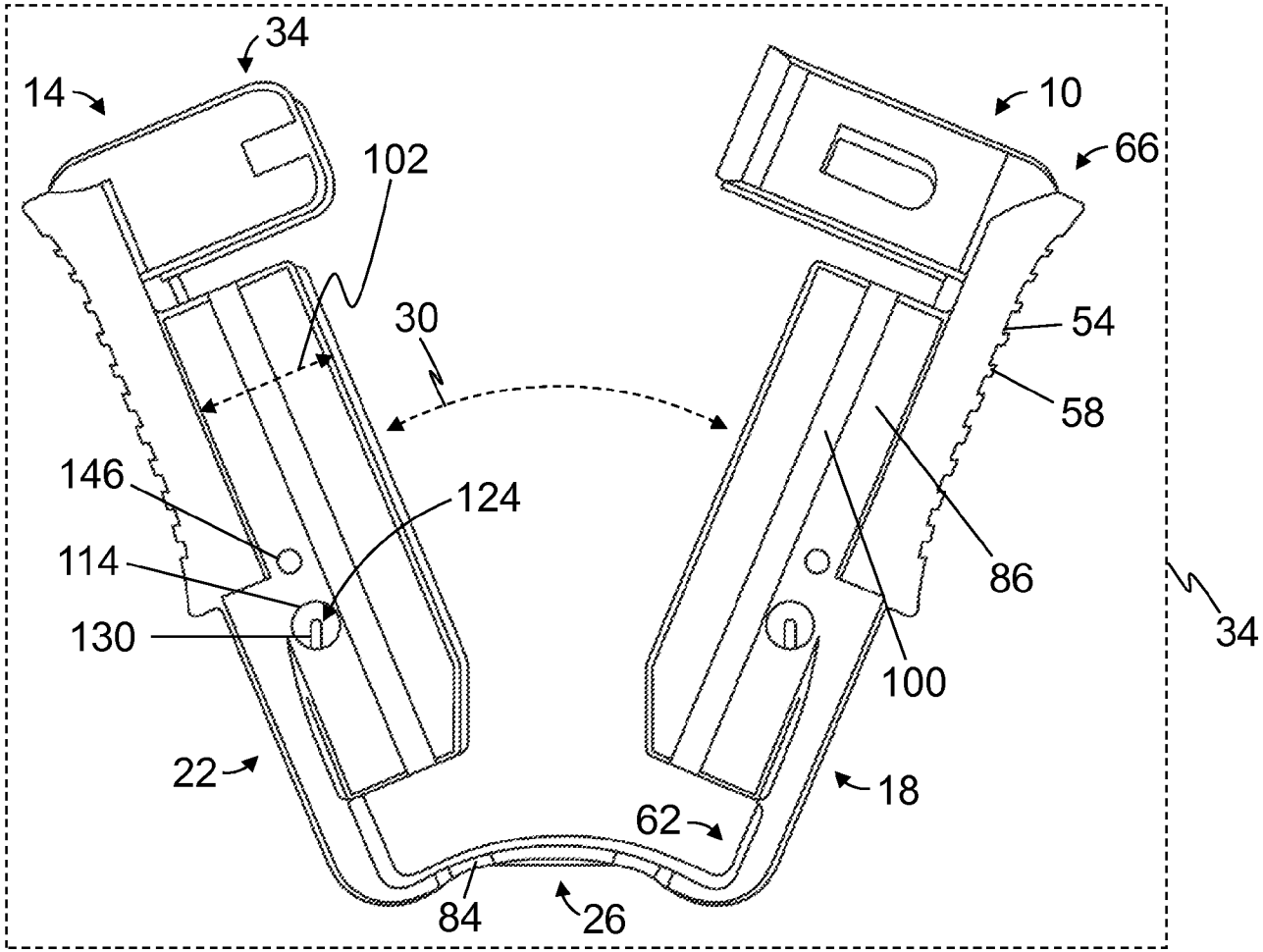
FIG. 1B is a top view of the embodiment of FIG. 1A, shown in an open position.
Figure 1C:
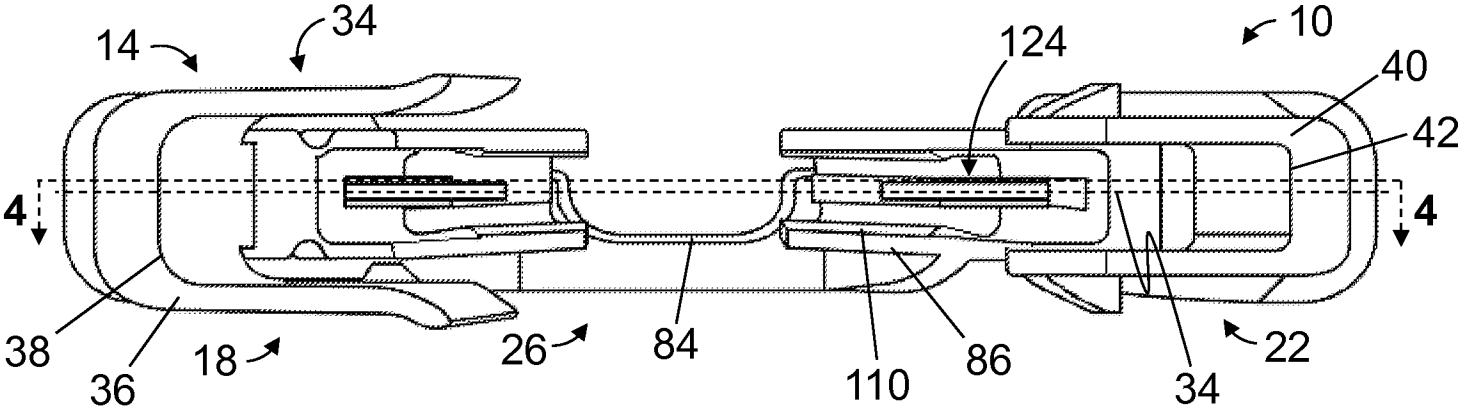
FIG. 1C is a front view of the embodiment of FIG. 1A, shown in an open position.
Figure 2A:
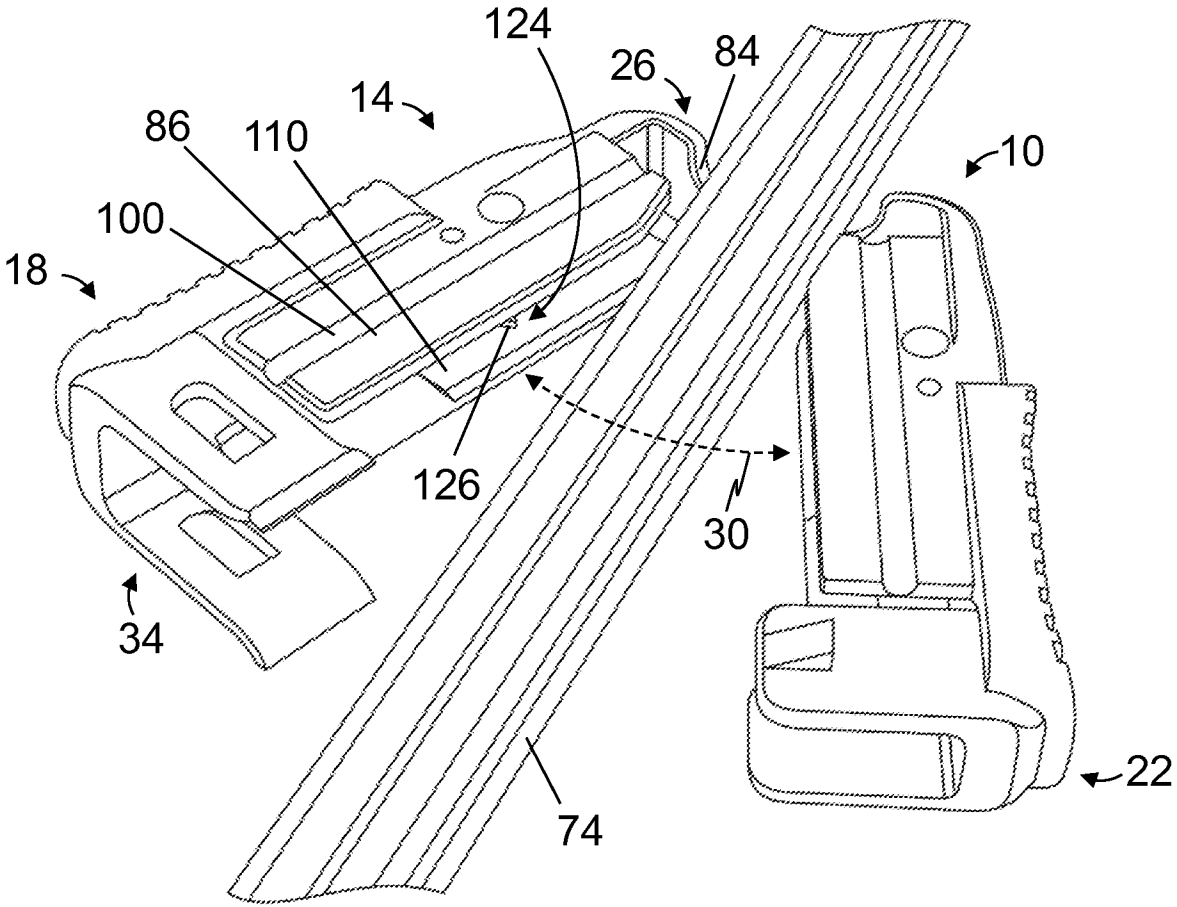
FIG. 2A is a perspective view of the embodiment of FIG. 1A, show in an open position and with an electrical cable.
Figure 2B:
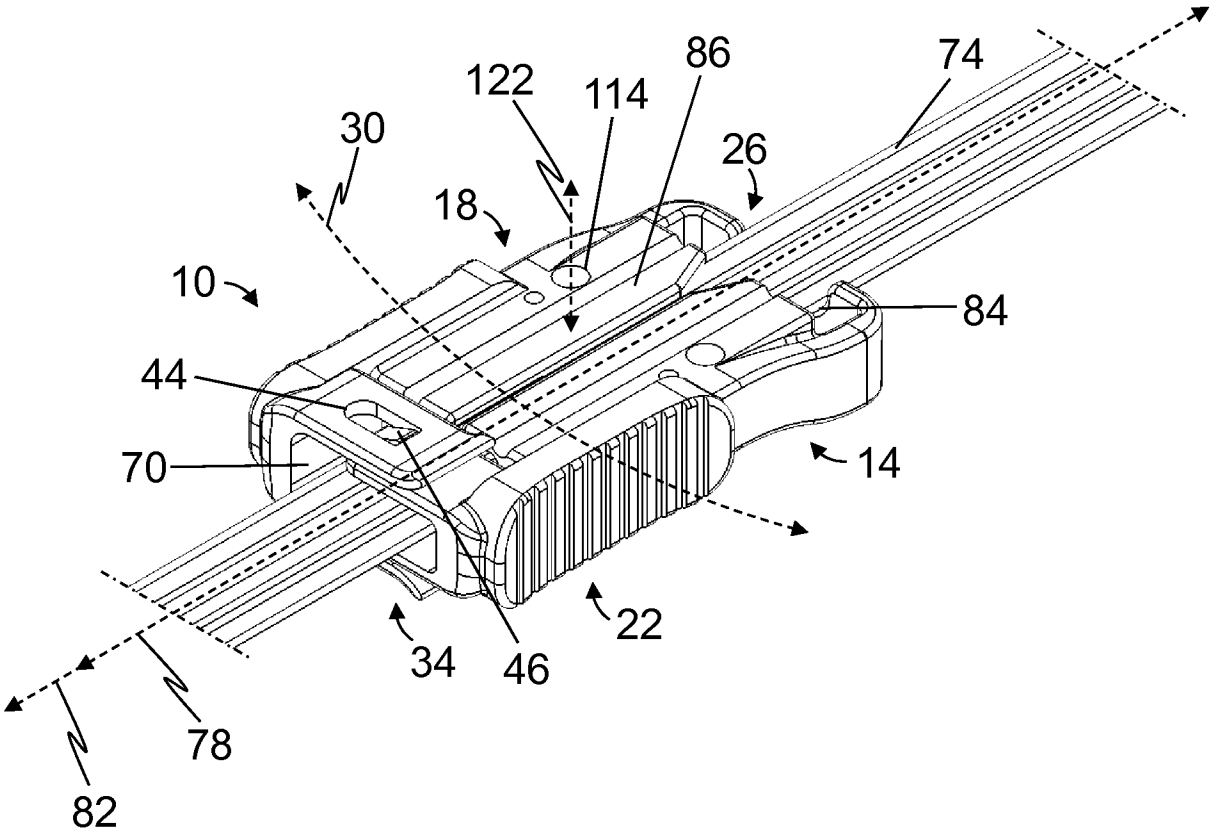
FIG. 2B is a perspective view of the embodiment of FIG. 1A, shown in a closed position and with an electrical cable.

In the embodiment shown, flexible sidewall 86 is configured such that an interior transverse dimension 106 of cable passageway 70 varies along longitudinal axis 78 of the cable passageway (FIG. 3D). For example, in this embodiment, flexible sidewall 86 defines one or more raised surfaces or protrusions 110, which extend from the flexible sidewall and into cable passageway 70. In this way, for example, raised surfaces or protrusions 110 may function to guide an electrical cable 74 into cutting point or edge 126 of piercing conductor 124, assist electrical connector 10 in retention of the electrical cable, and/or the like. In the depicted embodiment, flexible sidewall 86 tapers in a transverse dimension 102 along longitudinal axis 78 of cable passageway 70 (FIG. 1B). In this way, for example, flexible sidewall 86 may be configured to facilitate placement and/or removal of an electrical cable 74 between first and second clamp portions, 18 and 22, respectively, when the first and second clamp portions are in the open position (e.g., by minimizing physical interferences between the electrical cable and the first and second clamp portions).

In the embodiment shown, cable clamp 14 comprises a fixture wire passageway 114 (e.g., in this embodiment, two fixture wire passageways, each defined by a respective one of first clamp portion 18 and second clamp portion 22) configured to receive a fixture wire 118. In the depicted embodiment, fixture wire passageway 114 has a longitudinal axis 122 that is non-parallel (e.g., perpendicular or substantially perpendicular) to longitudinal axis 78 of cable passageway 70 (e.g., and/or non-parallel to plane 34). In this way, for example, some embodiments of the present electrical connectors may be configured to place an electrical device (e.g., a light fixture) into electrical communication with an electrical cable via a fixture wire, while minimizing bending of the electrical cable and/or fixture wire, unnecessary and/or unattractive use of electrical cable and/or fixture wire, and/or the like. In some embodiments, a fixture wire 118 is disposed within fixture wire passageway 114.

Figure 4:
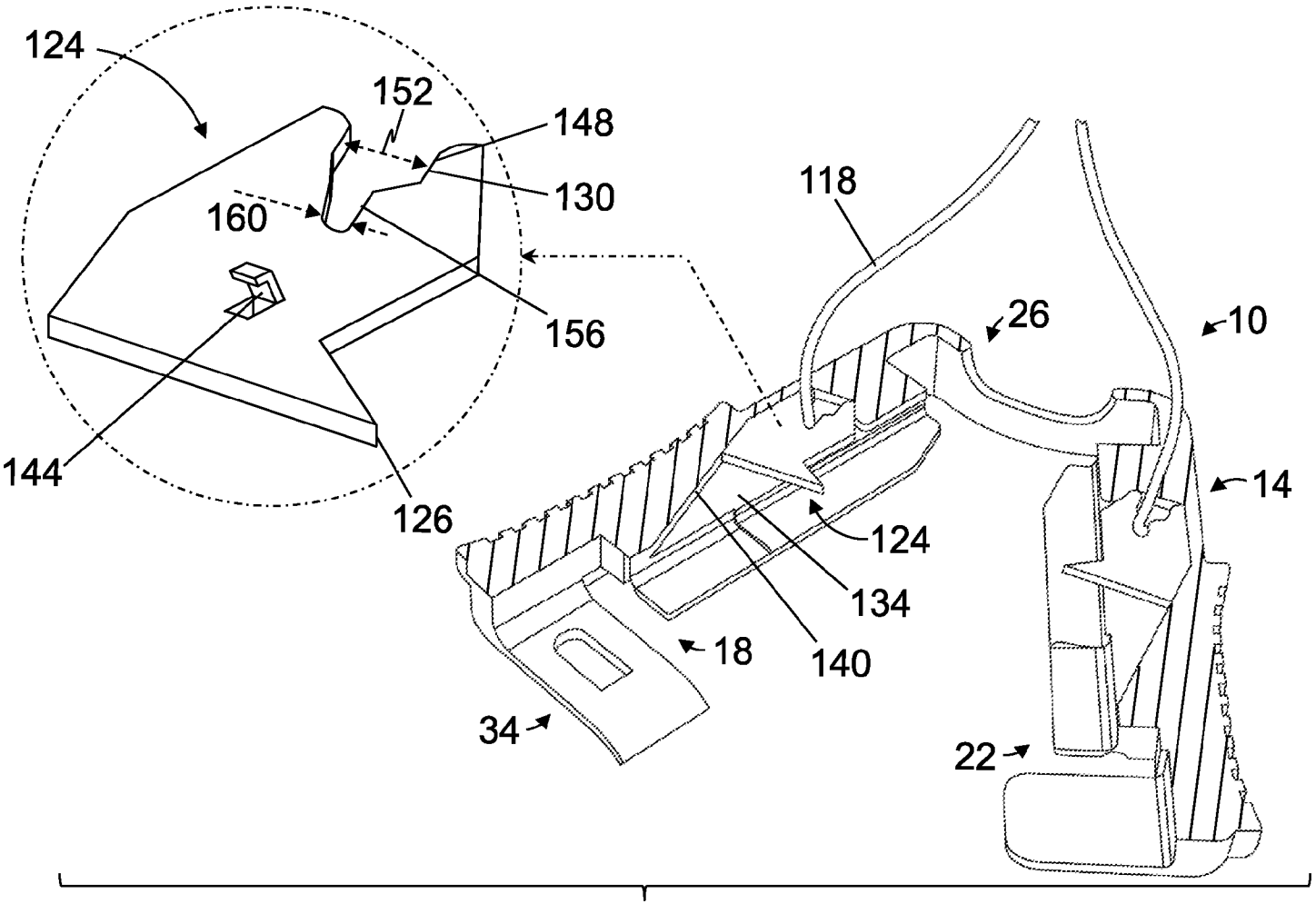
FIG. 4 is a partially cutaway perspective view of the embodiment of FIG. 1A, shown in an open position.

In the embodiment shown, electrical connector 10 comprises a piercing conductor 124 coupled to cable clamp 14 and configured to place a fixture wire 118 disposed within fixture wire passageway 114 into electrical communication with an electrical cable 74 disposed within cable passageway 70. In this embodiment, electrical connector 10 comprises two piercing conductors 124, each coupled to a respective one of first clamp portion 18 and second clamp portion 22 and configured to place a respective fixture wire 118 into electrical communication with a respective one of two or more cores of electrical cable 74 (e.g., electrical cable 74 is a multicore cable, for example, having a neutral first core and a power second core, a positive first core and a negative second core, and/or the like). For example, in the depicted embodiment, piercing conductor 124 comprises a cutting point or edge 126 configured to cut insulation around and contact a core of electrical cable 74 within cable passageway 70 as first and second clamp portions, 18 and 22, respectively, are moved towards the closed position. In the embodiment shown, cutting point or edge 126 is in electrical communication with a slot or opening 130 (described below) of piercing conductor 124, which is configured to receive and be in electrical communication with a fixture wire 118 (FIG. 4). In this embodiment, cutting point or edge 126 is configured to cut insulation around electrical cable 74 in a direction substantially parallel to longitudinal axis 78 of cable passageway 70.

In the depicted embodiment, slot or opening 130 defines a first portion 148 that extends from a second portion 156 of the slot or opening and through piercing conductor 124. In the embodiment shown, first portion 148 has a transverse dimension 152 that is larger than a transverse dimension 160 of second portion 156 (FIG. 4). In this way, for example, a fixture wire 118 (e.g., disposed within fixture wire passageway 114) may be received by first portion 148 and guided by slot or opening 130 into second portion 156 (e.g., as the piercing conductor moves relative to cable clamp 14, as described below). In some embodiments (e.g., 10), insulation of a fixture wire 118 may be cut by piercing conductor 124, and more particularly, by slot or opening 130 (e.g., in a direction substantially perpendicular to longitudinal axis 122 of fixture wire passageway 114) (e.g., via a cutting point or edge disposed within the slot or opening, second portion 156 having a smaller transverse dimension 160 than a transverse dimension of the fixture wire, misalignment between the second portion and fixture wire passageway 114, and/or the like).

In some embodiments (e.g., 10), a piercing conductor 124 may be press and/or friction fit into a respective one of first clamp portion 18 and second clamp portion 22, such that, for example, a fixture wire 118 is retained relative to the respective clamp portion and in electrical communication with the piercing conductor (e.g., as described above). For example, in this embodiment, piercing conductor 124 may be received by an interior channel 134 defined by the respective clamp portion. In the depicted embodiment, interior channel 134 defines a sidewall 140, which may guide piercing conductor 124 towards a fixture wire 118 disposed within fixture wire passageway 114. In the embodiment shown, piercing conductor 124 comprises a barb or protrusion 144 configured to secure the piercing conductor relative to cable clamp 14. For example, in this embodiment, barb or protrusion 114 may be received by a detent or opening 146 defined by the respective clamp portion once the piercing conductor is in electrical communication with fixture wire 118.

Some embodiments of the present methods comprise disposing a fixture wire (e.g., 118) into a fixture wire passageway (e.g., 114) of a first clamp portion (e.g., 18) of a cable clamp (e.g., 14), and inserting a piercing conductor (e.g., 124) into the first clamp portion such that the fixture wire is retained relative to the first clamp portion and is in electrical communication with the piercing conductor. In at least some of these embodiments, the cable clamp comprises a second clamp portion (e.g., 22) movable relative to the first clamp portion to a closed position (e.g., FIGS. 2B-3F) in which the cable clamp defines a cable passageway (e.g., 70) having a longitudinal axis (e.g., 78) that is substantially aligned with a longitudinal axis (e.g., 82) of the cable clamp when the first and second clamp portions are in the closed position. In at least some of these embodiments, inserting the piercing conductor cuts insulation of the fixture wire.

In other embodiments of the present methods, a respective piercing conductor (e.g., 124) may be configured to retain a fixture wire 118 as a respective first clamp portion (e.g., 18) is moved relative to a respective second clamp portion (e.g., 22) to the closed position. For example, in some embodiments, during piercing or cutting of an electrical cable 74, the electrical cable may supply a reactive force to a respective piercing conductor (e.g., to a respective cutting point or edge 126) that tends to close (e.g., by deformation of the respective piercing conductor) a respective opening or slot 130 around a fixture wire 118. In some of these embodiments, a respective piercing conductor 124 may be movably coupled to a respective first clamp portion (e.g., 18) or a respective second clamp portion (e.g., 22) (e.g., slidably disposed within a respective channel 134), and piercing or cutting of an electrical cable 74 may cause the respective piercing conductor to retain a fixture wire 118 (e.g., with a respective sidewall 140 of the respective channel configured to induce movement of the respective piercing conductor towards the fixture wire as the respective piercing conductor pierces or cuts an electrical cable 84).

Some embodiments of the present methods comprise: disposing an electrical cable (e.g., 74) within a recess defined by a first clamp portion (e.g., defined by first clamp portion 18, such as by a flexible sidewall 86 of the first clamp portion) of a cable clamp (e.g., 14); and moving a second clamp portion (e.g., 22) of the cable clamp relative to the first clamp portion to a closed position (e.g., FIGS. 2B-3F) in which the cable clamp defines a cable passageway (e.g., 70) having a longitudinal axis (e.g., 78) that is substantially aligned with a longitudinal axis (e.g., 82) of the cable clamp when the first and second clamp portions are in the closed position. Some of these embodiments further comprise: placing a fixture wire (e.g., 118) into electrical communication with the electrical cable, when the fixture wire disposed in a fixture wire passageway (e.g., 114) of the cable clamp that has a longitudinal axis (e.g., 122) that is non-parallel to the longitudinal axis of the cable passageway.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A cable clamp comprising:

a first clamp portion coupled to a first piercing conductor configured to be in contact with a first fixture wire;

a second clamp portion coupled to a second piercing conductor and to the first clamp portion through a hinge, the hinge coupling the first and second clamp portions to each other such that the first and second clamp portions are movable relative to each other in a plane between an open position and a closed position, the second piercing conductor configured to be in contact with a second fixture wire;

the first clamp portion including:

a first outer contact surface positioned to be contacted by a user to move the first and second clamp portions to the closed position;

a first wall spaced apart from the first outer contact surface that will be beside an electrical cable held by the cable clamp and pierced by the first and second piercing conductors when the first and second clamp portions are in the closed position;

a first portion having a first portion outer edge, the first portion being thinner at a first location than at a second location, wherein the first location is closer to the first outer contact surface than is the second location; and a second portion spaced apart from the first portion;

the second clamp portion including:

a second outer contact surface positioned to be contacted by a user to move the first and second clamp portions to the closed position;

a second wall spaced apart from the second outer contact surface that will be beside an electrical cable held by the cable clamp and pierced by the first and second piercing conductors when the first and second clamp portions are in the closed position;

a third portion having a third portion outer edge, the third portion being thinner at a third location than at a fourth location, wherein the third location is closer to the second outer contact surface than is the fourth location; and a fourth portion spaced apart from the third portion; and one of the first and second clamp portions including a segment that extends toward the other of the first and second clamp portions when the first and second clamp portions are in a closed position and that includes a locking protrusion, the hinge and the segment being located at opposite ends of the cable clamp when the first and second clamp portions are in the closed position;

wherein when an electrical cable is held by the cable clamp and pierced by the first and second piercing conductors:

the first portion of the first clamp portion and the third portion of the second clamp portion will be nearer a first side of the electrical cable than a second side of the electrical cable, and the second portion of the first clamp portion and the fourth portion of the second clamp portion will be nearer the second side of the electrical cable than the first side of the electrical cable; and the hinge and the segment will both be positioned on the first side or the second side of the electrical cable.

2. The cable clamp of claim 1, wherein the hinge is a living hinge.

3. A cable clamp comprising:

a first clamp portion coupled to a first piercing conductor;

a second clamp portion coupled to a second piercing conductor and to the first clamp portion through a hinge, the hinge coupling the first and second clamp portions to each other such that the first and second clamp portions are movable relative to each other between an open position and a closed position;

the first clamp portion including:

a first outer contact surface positioned to be contacted by a user to move the first and second clamp portions to the closed position;

a first portion having a first portion outer edge, the first portion being thinner at a first location than at a second location, wherein the first location is closer to the first outer contact surface than is the second location; and a second portion spaced apart from the first portion;

the second clamp portion including:

a second outer contact surface positioned to be contacted by a user to move the first and second clamp portions to the closed position;

a third portion having a third portion outer edge, the third portion being thinner at a third location than at a fourth location, wherein the third location is closer to the second outer contact surface than is the fourth location; and a fourth portion spaced apart from the second portion; and one of the first and second clamp portions including a segment that extends toward the other of the first and second clamp portions when the first and second clamp portions are in a closed position and that includes a locking protrusion;

wherein when an electrical cable is held by the cable clamp and pierced by the first and second piercing conductors:

the first portion of the first clamp portion and the third portion of the second clamp portion will be nearer a first side of the electrical cable than a second side of the electrical cable, and the second portion of the first clamp portion and the fourth portion of the second clamp portion will be nearer the second side of the electrical cable than the first side of the electrical cable; and the hinge and the segment will both be positioned on the first side or the second side of the electrical cable.

4. The cable clamp of claim 3, wherein the hinge is a living hinge.

5. A cable clamp comprising:

a first clamp portion coupled to a first piercing conductor configured to be in contact with a first fixture wire;

a second clamp portion coupled to a second piercing conductor and to the first clamp portion through a hinge, the hinge coupling the first and second clamp portions to each other such that the first and second clamp portions are movable relative to each other in a plane between an open position and a closed position, the second piercing conductor configured to be in contact with a second fixture wire;

the first clamp portion including:

a first outer contact surface positioned to be contacted by a user to move the first and second clamp portions to the closed position;

a first surface spaced apart from the first outer contact surface and that will be beside an electrical cable held by the cable clamp and pierced by the first and second piercing conductors when the first and second clamp portions are in a closed position;

a first portion having an outer edge and including a groove separated from the outer edge by a first portion segment, the groove allowing the first portion segment to deflect; and a second portion spaced apart from the first portion;

the second clamp portion including:

a second outer contact surface positioned to be contacted by a user to move the first and second clamp portions to the closed position;

a second surface spaced apart from the second outer contact surface and that will be beside an electrical cable held by the cable clamp and pierced by the first and second piercing conductors when the first and second clamp portions are in a closed position;

a third portion having an outer edge and including a groove separated from the outer edge of the third portion by a third portion segment, the groove of the third portion allowing the third portion segment to deflect; and a fourth portion spaced apart from the third portion; and one of the first and second clamp portions including a segment that extends toward the other of the first and second clamp portions when the first and second clamp portions are in a closed position and that includes a locking protrusion, the hinge and the segment being located at opposite ends of the cable clamp when the first and second clamp portions are in the closed position;

wherein when an electrical cable is held by the cable clamp and pierced by the first and second piercing conductors:

the first portion of the first clamp portion and the third portion of the second clamp portion will be nearer a first side of the electrical cable than a second side of the electrical cable, and the second portion of the first clamp portion and the fourth portion of the second clamp portion will be nearer the second side of the electrical cable than the first side of the electrical cable; and the hinge and the segment will both be positioned on the first side or the second side of the electrical cable.

6. The cable clamp of claim 5, wherein the hinge is a living hinge.

7. A cable clamp comprising:

a first clamp portion coupled to a first piercing conductor;

a second clamp portion coupled to a second piercing conductor and to the first clamp portion through a hinge, the hinge coupling the first and second clamp portions to each other such that the first and second clamp portions are movable relative to each other between an open position and a closed position;

the first clamp portion including:

a first outer contact surface positioned to be contacted by a user to move the first and second clamp portions to the closed position;

a first portion having an outer edge and including a groove positioned closer to the first outer contact surface than is the outer edge; and a second portion spaced apart from the first portion;

the second clamp portion including:

a second outer contact surface positioned to be contacted by a user to move the first and second clamp portions to the closed position;

a third portion having an outer edge and including a groove positioned closer to the second outer contact surface than is the outer edge of the third portion; and a fourth portion spaced apart from the second portion; and one of the first and second clamp portions including a segment that extends toward the other of the first and second clamp portions when the first and second clamp portions are in a closed position and that includes a locking protrusion;

wherein when an electrical cable is held by the cable clamp and pierced by the first and second piercing conductors:

the first portion of the first clamp portion and the third portion of the second clamp portion will be nearer a first side of the electrical cable than a second side of the electrical cable, and the second portion of the first clamp portion and the fourth portion of the second clamp portion will be nearer the second side of the electrical cable than the first side of the electrical cable; and the hinge and the segment will both be positioned on the first side or the second side of the electrical cable.

8. The cable clamp of claim 7, wherein the hinge is a living hinge.

* * * * *